US010876769B2

(12) United States Patent
Yamada

(10) Patent No.: US 10,876,769 B2
(45) Date of Patent: Dec. 29, 2020

(54) CRYOCOOLER

(71) Applicant: SUMITOMO HEAVY INDUSTRIES, LTD., Tokyo (JP)

(72) Inventor: Koji Yamada, Nishitokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 248 days.

(21) Appl. No.: 15/608,158

(22) Filed: May 30, 2017

(65) Prior Publication Data

US 2017/0343248 A1 Nov. 30, 2017

(30) Foreign Application Priority Data

May 31, 2016 (JP) ..... 2016-108964

(51) Int. Cl.
*F25B 9/14* (2006.01)

(52) U.S. Cl.
CPC ..... *F25B 9/14* (2013.01); *F25B 2309/003* (2013.01); *F25B 2309/006* (2013.01); *F25B 2309/1428* (2013.01)

(58) Field of Classification Search
CPC ..... F25B 9/14; F25B 2309/1428; F25B 2309/006; F25B 2309/003; F25B 9/10; F25B 2309/02
See application file for complete search history.

(56) References Cited

U.S. PATENT DOCUMENTS 5,642,618 A * 7/1997 Penswick ..... F02G 1/0435 60/520
2014/0290277 A1* 10/2014 Yamada ..... F25B 9/14 62/6

FOREIGN PATENT DOCUMENTS

JP 2014-194291 A 10/2014

* cited by examiner

*Primary Examiner* — Frantz F Jules
*Assistant Examiner* — Webeshet Mengesha
(74) *Attorney, Agent, or Firm* — HEA Law PLLC

(57) ABSTRACT

A cryocooler includes: a housing furnished with a housing bottom surface; a displacer furnished with a displacer upper surface between the housing bottom surface and which an upper gas chamber is formed, and being enabled to reciprocate axially with respect to the housing; a housing gas flow path formed in the housing and opening onto the upper gas chamber; a displacer upper gas flow path formed in the displacer and opening onto the upper gas chamber; and a gas-guiding flow channel formed in at least either the housing bottom surface or the displacer upper surface constituting a portion of the upper gas chamber, and interconnecting the housing gas flow path and the displacer upper gas flow path when the displacer is positioned at top-dead center in its axial reciprocation.

5 Claims, 5 Drawing Sheets

14

CRYOCOOLER

RELATED APPLICATIONS

Priority is claimed to Japanese Patent Application No. 2016-108964, filed May 31, 2016, the entire content of which is incorporated herein by reference.

BACKGROUND

Technical Field

Certain embodiments of the present invention relate to cryocoolers.

Description of Related Art

Cryocoolers, typified by Gifford-McMahon (GM) refrigerators, include working-gas (also called refrigerant-as) expanders and compressors. Expanders for the most part include a displacer that is axially reciprocated by a driving means, and a regenerator that is built into the displacer. The displacer is accommodated in a cylinder that guides its reciprocation. The variable volume that by the relative movement of the displacer with respect to the cylinder is formed between the two is employed as the working-gas expansion chamber. Appropriate synchronizing of the expansion-chamber volume change and pressure change enables the expander to produce coldness.

SUMMARY

The present invention in one embodiment affords a cryocooler including: a housing including a housing bottom surface; a displacer including a displacer upper surface between the housing bottom surface and which an upper gas chamber is formed, and being enabled to reciprocate axially with respect to the housing; a housing gas flow path formed in the housing and opening onto the upper gas chamber; a displacer upper gas flow path formed in the displacer and opening onto the upper gas chamber; and a gas-guiding flow channel formed in at least either the housing bottom surface or the displacer upper surface constituting a portion of the upper gas chamber, and interconnecting the housing gas flow path and the displacer upper gas flow path when the displacer is positioned at top-dead center in its axial reciprocation.

DETAILED DESCRIPTION

Figure 1:
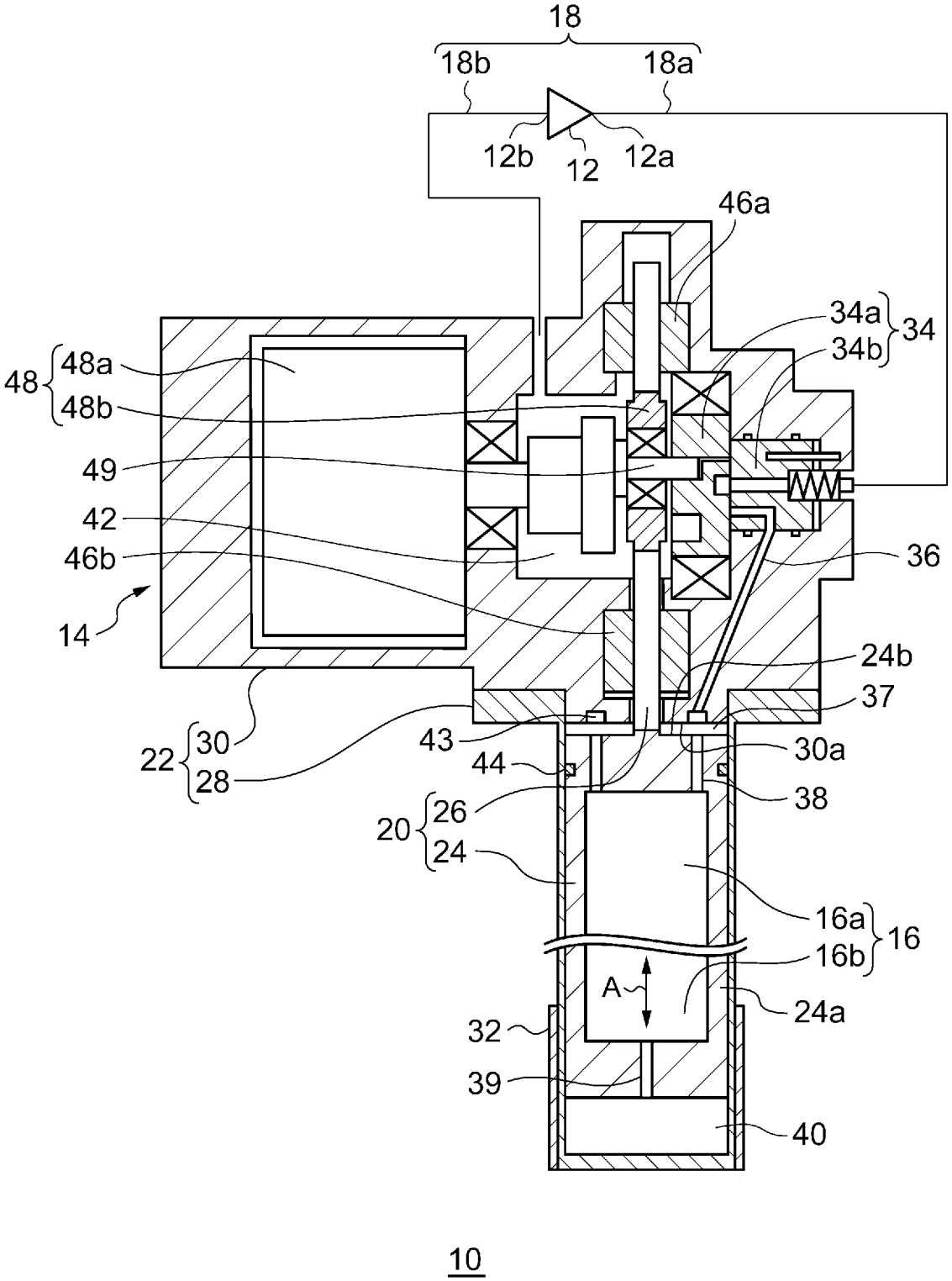
FIG. 1 is a view schematically showing an entire configuration of a cryocooler according to one embodiment.

A housing which can accommodate the driving means of the displacer is fixed to a cylinder on a side opposite to the expansion chamber in an axial direction. Another gas space is formed between the displacer and the housing in order to secure a stroke of axial reciprocation of the displacer. Unlike the expansion chamber, this gas space is a dead volume which does not contribute to generation of coldness. Accordingly, preferably, the dead volume is as small as possible as long as the stroke of the reciprocation of the displacer is appropriately secured.

The gas space formed between the displacer and the housing can have another role of configuring a portion of a working gas flow path in the cryocooler. In a case where the gas space is excessively narrow, particularly, when the displacer is positioned at a top dead center in the reciprocation, an excessive pressure drop may occur in a flow of gas flowing through the gas space. As a result, refrigerating capacity of the cryocooler may decrease.

It is desirable to prevent an excessive increase of the dead volume while decreasing the pressure drop in the working gas flow path of the cryocooler.

According to the present invention, it is possible to prevent an excessive increase of a dead volume while decreasing a pressure drop in a working gas flow path of a cryocooler.

Hereinafter, embodiments of the present invention will be described in detail with reference to the drawings.

In addition, in descriptions thereof, the same reference numerals are assigned to the same elements, and overlapping descriptions are appropriately omitted. Moreover, configurations described below are exemplified and do not limit the scope of the present invention.

FIG. 1 is a view schematically showing a cryocooler 10 according to an embodiment. The cryocooler 10 includes a compressor 12 which compresses a working gas and an expander 14 which cools the working gas by adiabatic expansion. For example, the working gas is helium gas. The expander 14 may be also referred to as a cold head. A regenerator 16 which pre-cools the working gas is included in the expander 14. The cryocooler 10 includes a gas pipe 18 which includes a first pipe 18*a* and a second pipe 18*b* which are respectively connected to the compressor 12 and the expander 14. The shown cryocooler 10 is a single-stage GM cryocooler.

As is well known, a working gas having a first high-pressure is supplied from a discharging port 12*a* of the compressor 12 to the expander 14 through the first pipe 18*a*. The pressure of the working gas is decreased from the first high-pressure to a second high-pressure which is lower than the first high-pressure due to adiabatic expansion in the expander 14. The working gas having the second high-pressure is returned from the expander 14 to a suction port 12*b* of the compressor 12 through the second pipe 18*b*. The compressor 12 compresses the returned working gas having the second high-pressure. Accordingly, the pressure of the working gas increases to the first high-pressure again. In general, the first high-pressure and the second high-pressure are significantly higher than the atmospheric pressure. For convenience of descriptions, the first high-pressure and the second high-pressure are simply referred to as a high pressure and a low pressure, respectively. Typically, for example, the high pressure is 2 to 3 MPa, and the low pressure is 0.5 to 1.5 MPa. For example, a difference between the high pressure and the low pressure is approximately 1.2 to 2 MPa.

The expander 14 includes an expander movable portion 20 and an expander stationary portion 22. The expander movable portion 20 is configured so as to reciprocate in an axial direction (up-down direction in FIG. 1) with respect to the expander stationary portion 22. The movement direction of the expander movable portion 20 is indicated by an arrow A in FIG. 1. The expander stationary portion 22 is configured so as to support the expander movable portion 20 to be reciprocated in the axial direction. In addition, the expander stationary portion 22 is configured of an airtight container in which the expander movable portion 20 is accommodated along with a high-pressure gas (including first high-pressure gas and second high-pressure gas).

The expander movable portion 20 includes a displacer 24 and a displacer drive shaft 26 which reciprocates the displacer 24. A regenerator 16 is built in the displacer 24. The displacer 24 includes a displacer member 24*a* which surrounds the regenerator 16. An internal space of the displacer member 24*a* is filled with a regenerator material. Accordingly, the regenerator 16 is formed inside the displacer 24. For example, the displacer 24 has a substantially columnar shape which extends in the axial direction. The displacer member 24*a* includes an outer diameter and an inner diameter which are substantially constant in the axial direction. Accordingly, the regenerator 16 also has a substantially columnar shape which extends in the axial direction.

In addition, the displacer 24 includes a displacer upper surface 24*b*. The displacer upper surface 24*b* is a substantially circular region which is perpendicular to the axial direction. One end of the displacer drive shaft 26 is fixed to the center of the displacer upper surface 24*b*.

The expander stationary portion 22 approximately has two configurations which includes a cylinder 28 and a drive mechanism housing (hereinafter, simply referred to as a housing) 30. The upper portion of the expander stationary portion 22 in the axial direction is the housing 30, the lower portion of the expander stationary portion 22 in the axial direction is the cylinder 28, and the housing 30 and the cylinder 28 are firmly connected to each other. The cylinder 28 is configured to guide the reciprocation of the displacer 24. The cylinder 28 extends in the axial direction from the housing 30. The cylinder 28 has an inner diameter which is substantially constant in the axial direction, and accordingly, the cylinder 28 has a substantially cylindrical inner surface which extends in the axial direction. The inner diameter is slightly greater than the outer diameter of the displacer member 24*a*.

The housing 30 includes a housing bottom surface 30*a*. The housing bottom surface 30*a* is a portion of the surface of the housing 30 and faces the displacer upper surface 24*b*. The housing bottom surface 30*a* is parallel to the displacer upper surface 24*b* and, similarly to the displacer upper surface 24*b*, is a substantially circular region which is perpendicular to the axial direction. However, the center of the housing bottom surface 30*a* is penetrated by the displacer drive shaft 26. The displacer 24 can reciprocate in the axial direction with respect to the housing 30.

Moreover, the expander stationary portion 22 includes a cooling stage 32. The cooling stage 32 is fixed to the terminal of the cylinder 28 on the side opposite to the housing 30 in the axial direction. The cooling stage 32 is provided so as to transmit coldness generated by the expander 14 to other objects. The objects are attached to the cooling stage 32, and are cooled by the cooling stage 32 during the operation of the cryocooler 10.

In the present specification, for convenience of the description, terms such as an axial direction, a radial direction, and a circumferential direction are used. As shown by an arrow A, the axial direction indicates the movement direction of the expander movable portion 20 with respect to the expander stationary portion 22. The radial direction indicates a direction (a lateral direction in the drawing) perpendicular to the axial direction, and the circumferential direction indicates a direction which surrounds the axial direction. An element of the expander 14 being close to the cooling stage 32 in the axial direction may be referred to "down," and the element being far from the cooling stage 32 in the axial direction may be referred to as "up." Accordingly, a high-temperature portion and a low-temperature portion of the expander 14 are respectively positioned on the upper portion and the lower portion in the axial direction. The expressions are used so as to only assist understanding of a relative positional relationship between elements of the expander 14. Accordingly, the expressions are not related to the disposition of the expander 14 when the expander 14 is installed in site. For example, in the expander 14, the cooling stage 32 may be installed upward and the drive mechanism housing 30 may be installed downward. Alternatively, the expander 14 may be installed such that the axial direction coincides with a horizontal direction.

During the operation of the cryocooler 10, the regenerator 16 includes a regenerator high-temperature portion 16*a* on one side (upper side in the drawing) in the axial direction, and a regenerator low-temperature portion 16*b* on the side (lower side in the drawing) opposite to the regenerator high-temperature portion 16*a*. In this way, the regenerator 16 has a temperature distribution in the axial direction. Similarly, other components (for example, displacer 24 and cylinder 28) of the expander 14 which surrounds the regenerator 16 also have axial temperature distributions. Accordingly, the expander 14 includes a high-temperature portion on one side in the axial direction and a low-temperature portion on the other side in the axial direction during the operation of the expander 14. For example, the high-temperature portion has a temperature such as an approximately room temperature. The cooling temperatures of the low-temperature portion are different from each other according to the use of the cryocooler 10, and for example, the low-temperature portion is cooled to a temperature which is included in a range from approximately 10 K to approximately 100 K. The cooling stage 32 is fixed to the cylinder 28 to enclose the low-temperature portion of the cylinder 28.

Figure 2:
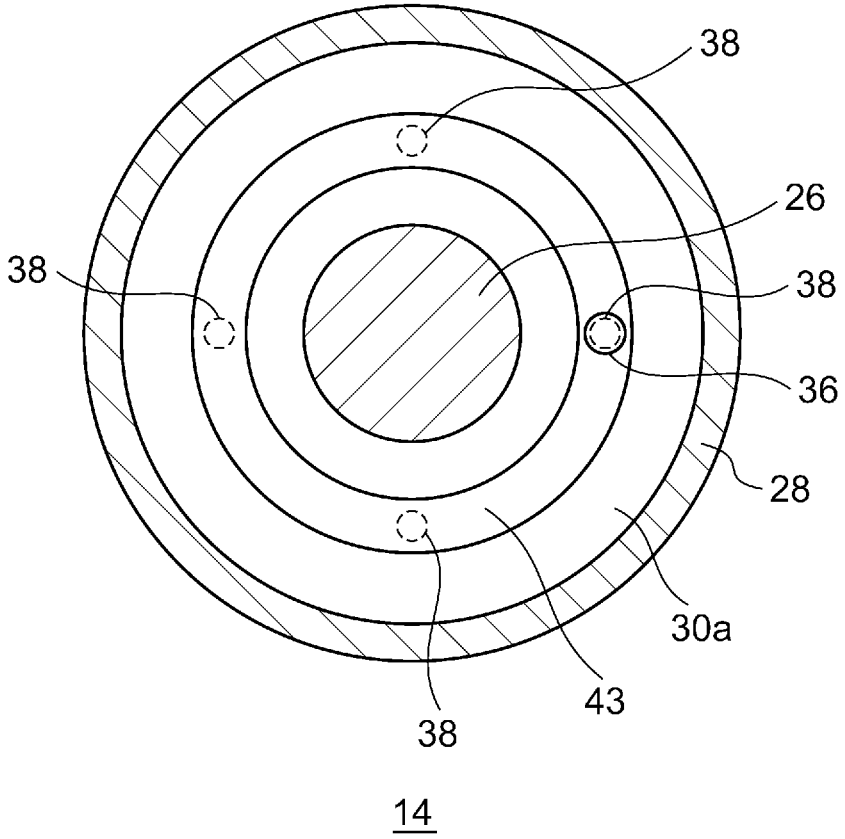
FIG. 2 shows a portion of a configuration of a working gas flow path of an expander according to the one embodiment.
Figure 3:
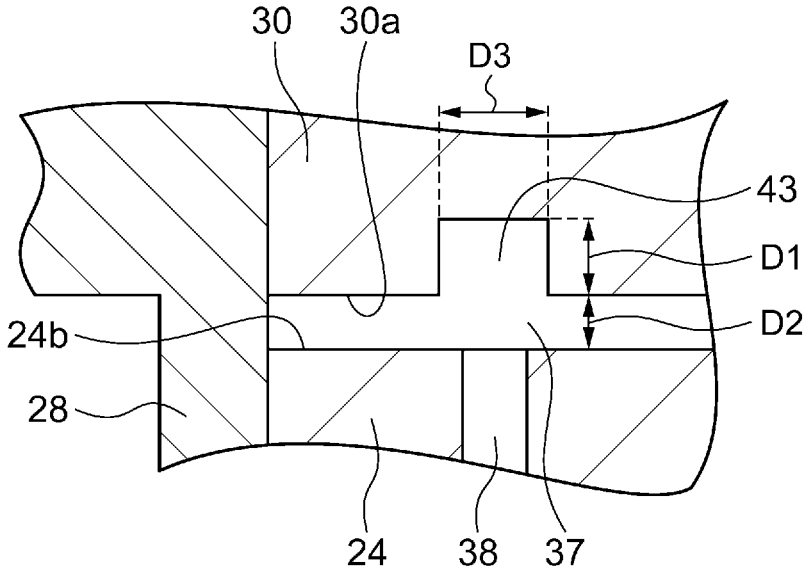
FIG. 3 shows a portion of the configuration of the working gas flow path of the expander according to the one embodiment.

A configuration of a working gas flow path in the expander 14 is described. FIGS. 2 and 3 show a portion of the configuration of the working gas flow path of the expander 14 according to the embodiment. FIGS. 2 and 3 show the displacer upper surface 24*b*, the housing bottom surface 30*a*, and the working gas flow path around these.

The expander 14 includes a valve portion 34, a housing gas flow path 36, an upper gas chamber 37, a displacer upper gas flow path 38, a displacer lower gas flow path 39, a gas expansion chamber 40, and a low-pressure gas chamber 42. A high-pressure gas flows from the first pipe 18*a* into the gas expansion chamber 40 via the valve portion 34, the housing gas flow path 36, the upper gas chamber 37, the displacer upper gas flow path 38, the regenerator 16, and the displacer lower gas flow path 39. The gas returned to the gas expansion chamber 40 flows to the low-pressure gas chamber 42 via the displacer lower gas flow path 39, the regenerator 16, the displacer upper gas flow path 38, the upper gas chamber 37, the housing gas flow path 36, and the valve portion 34.

Although it is described below in detail, the upper gas chamber 37 includes a gas-guiding flow channel 43.

The gas-guiding flow channel 43 is formed on the housing bottom surface 30*a* and configures a portion of the upper gas chamber 37. The gas-guiding flow channel 43 causes the housing gas flow path 36 to communicate with the displacer upper gas flow path 38 when the displacer 24 is positioned at a top dead center in the axial reciprocation. In FIG. 2, a cross section of the expander 14 along a plane perpendicular to the axial direction in the upper gas chamber 37 is schematically shown. FIG. 3 is an enlarged view showing a portion of the gas-guiding flow channel 43 shown in FIG. 1.

The valve portion 34 is configured to control the pressure of the gas expansion chamber 40 to be synchronized with the reciprocation of the displacer 24. The valve portion 34 functions as a portion of a supply path for supplying a high-pressure gas to the gas expansion chamber 40, and functions as a portion of a discharging path for discharging a low-pressure gas from the gas expansion chamber 40. The valve portion 34 is configured to end the discharging of the low-pressure gas and to start the supply of the high-pressure gas when the displacer 24 passes a bottom dead center or the vicinity thereof. The valve portion 34 is configured to end the supply of the high-pressure gas and to start the discharging of the low-pressure gas when the displacer 24 passes a top dead center or the vicinity thereof. In this way, the valve portion 34 is configured to switch the supply function and the discharging function of the working gas to be synchronized with the reciprocation of the displacer 24.

The housing gas flow path 36 is formed so as to penetrate the housing 30 such that gas flows between the expander stationary portion 22 and the upper gas chamber 37. The housing gas flow path 36 is formed in the housing 30 and is open to the upper gas chamber 37. The housing gas flow path 36 starts from the valve portion 34 and terminates at the upper gas chamber 37. That is, one end of the housing gas flow path 36 is connected to a gas passage of the valve portion 34 and the other end of the housing gas flow path 36 is connected to the upper gas chamber 37.

The upper gas chamber 37 is formed between the expander stationary portion 22 and the displacer 24 on the regenerator high-temperature portion 16*a* side. More specifically, the upper gas chamber 37 is interposed between the housing bottom surface 30*a* and the displacer upper surface 24*b* in the axial direction, and is surrounded by the cylinder 28 in the circumferential direction. The upper gas chamber 37 is adjacent to the low-pressure gas chamber 42. The upper gas chamber 37 is also referred to as a room temperature chamber. The upper gas chamber 37 is a variable volume which is formed between the expander movable portion 20 and the expander stationary portion 22.

The displacer upper gas flow path 38 is formed in the displacer 24 and is open to the upper gas chamber 37. The displacer upper gas flow path 38 is at least one hole of the displacer member 24*a* which is formed to cause the regenerator high-temperature portion 16*a* to communicate with the upper gas chamber 37.

Specifically, the displacer upper gas flow path 38 includes a plurality of holes which are formed on the displacer upper surface 24*b*. The plurality of holes penetrate the displacer member 24*a* in the axial direction from the displacer upper surface 24*b* to the regenerator high-temperature portion 16*a*. In addition, the holes are arranged on the displacer upper surface 24*b* so as to surround the displacer drive shaft 26. The plurality of holes are disposed at equal angle intervals in the circumferential direction on a circumference which has the central axis of the displacer as a center. For example, four holes are formed every 90° on the displacer upper surface 24*b*, and the four holes are equidistant from the center of the displacer upper surface 24*b*.

For understanding, the displacer upper gas flow path 38 is shown by dashed lines in FIG. 2.

Among the plurality of holes, one hole is disposed at the same position (that is, immediately below the housing gas flow path 36) as the position of the housing gas flow path 36 in a cross section along a plane perpendicular to the axial direction. Among the plurality of holes, remaining holes are formed at positions different from the position of the housing gas flow path 36 in the cross section along the plane perpendicular to the axial direction.

As shown in FIG. 1, the displacer lower gas flow path 39 is at least one hole of the displacer member 24*a* which is formed to cause the regenerator low-temperature portion 16*b* to communicate with the gas expansion chamber 40.

A seal portion 44 which seals a clearance between the displacer 24 and the cylinder 28 is provided on the side surface of the displacer member 24*a*. The seal portion 44 may be attached to the displacer member 24*a* so as to surround the displacer upper gas flow path 38 in the circumferential direction.

The gas expansion chamber 40 is formed between the cylinder 28 and the displacer 24 on the regenerator low-temperature portion 16*b* side. Similarly to the upper gas chamber 37, the gas expansion chamber 40 is a variable volume which is formed between the expander movable portion 20 and the expander stationary portion 22, and the volume of the gas expansion chamber 40 is complementarily changed with the volume of the upper gas chamber 37 by the relative movement of the displacer 24 with respect to the cylinder 28. Since the seal portion 44 is provided, a direct gas flow (that is, the flow of gas which bypasses the regenerator 16) between the upper gas chamber 37 and the gas expansion chamber 40 is not generated.

The low-pressure gas chamber 42 is defined inside the housing 30. The second pipe 18*b* is connected to the housing 30. Accordingly, the low-pressure gas chamber 42 communicates with the suction port 12*b* of the compressor 12 through the second pipe 18*b*. Therefore, the low-pressure gas chamber 42 is always maintained to a low pressure.

A drive configuration of the expander 14 will be described. As shown in FIG. 1, the displacer drive shaft 26 protrudes from the displacer 24 to the low-pressure gas chamber 42 through the upper gas chamber 37. The expander stationary portion 22 includes a pair of drive shaft guides 46*a* and 46*b* which support the displacer drive shaft 26 in the axial direction in a movable manner. Each of the drive shaft guides 46*a* and 46*b* is provided in housing 30 so as to surround the displacer drive shaft 26. The drive shaft guide 46*b* positioned on the lower side in the axial direction or the lower end section of the housing 30 is airtightly configured. Accordingly, the low-pressure gas chamber 42 is separated from the upper gas chamber 37. The direct gas flow between the low-pressure gas chamber 42 and the upper gas chamber 37 is not generated.

The expander 14 includes a drive mechanism 48 which drives the displacer 24. The drive mechanism 48 is accommodated in the low-pressure gas chamber 42 and includes a motor 48*a* and a scotch yoke mechanism 48*b*. The displacer drive shaft 26 forms a portion of the scotch yoke mechanism 48*b*. In addition, the scotch yoke mechanism 48*b* includes a crank pin 49 which extends to be parallel to the output shaft of the motor 48*a* and is eccentric to the output shaft. The displacer drive shaft 26 is connected to the scotch yoke mechanism 48*b* to be driven in the axial direction by the scotch yoke mechanism 48*b*. Accordingly, the displacer 24 is reciprocated in the axial direction by the rotation of the motor 48*a*. The scotch yoke mechanism 48*b* is interposed between the drive shaft guides 46*a* and 46*b*, and the drive shaft guides 46*a* and 46*b* are positioned at different positions from each other in the axial direction.

The valve portion 34 is connected to the drive mechanism 48 and is accommodated in the housing 30. The valve portion 34 is a rotary valve type valve portion which includes a valve rotor 34*a* and a valve stator 34*b*. The valve rotor 34*a* and the valve stator 34*b* are disposed in the low-pressure gas chamber 42. The valve rotor 34*a* is connected to the output shaft of the motor 48*a* so as to be rotated by the rotation of the motor 48*a*. The valve rotor 34*a* is in surface-contact with the valve stator 34*b* so as to rotationally slide on the valve stator 34*b*. The valve stator 34*b* is fixed to the housing 30. The valve stator 34*b* is configured so as to receive the high-pressure gas which enters the housing 30 from the first pipe 18*a*.

The gas-guiding flow channel 43 will be described in detail. As shown in the drawings, the gas-guiding flow channel 43 is formed on the housing bottom surface 30*a* to face the plurality of holes configuring the displacer upper gas flow path 38. In addition, the housing gas flow path 36 is open to the gas-guiding flow channel 43. That is, an outlet of the housing gas flow path 36 is disposed on a bottom surface of the gas-guiding flow channel 43. According to this configuration, even when the displacer upper surface 24*b* is very close to the housing bottom surface 30*a* such as a case where the displacer 24 is positioned at the top dead center, a volume which allows a gas flow between the housing gas flow path 36 and the displacer upper gas flow path 38 is secured by the gas-guiding flow channel 43. In addition, since the gas-guiding flow channel 43 is relatively easily processed on the housing bottom surface 30*a*, a new load to a manufacturing process of the expander 14 is small.

The gas-guiding flow channel 43 is formed such that a volume of the gas-guiding flow channel 43 is equal to or less than half of a volume of the upper gas chamber 37 when the displacer 24 is positioned at the top dead center. According to this configuration, since the volume of the gas-guiding flow channel 43 is relatively formed small, it is possible to prevent a dead volume from excessively increasing due to the formation of the gas-guiding flow channel 43. Along with this, a pressure drop in the upper gas chamber 37 decreases when the displacer 24 is positioned at the top dead center and a decrease in refrigeration capacity of the cryocooler 10 is prevented.

Specifically, a height, a width, and a length of the gas-guiding flow channel 43 are determined such that the volume of the gas-guiding flow channel 43 is equal to or less than half of the volume of the upper gas chamber 37 when the displacer 24 is positioned at the top dead center. Here, for example, the height, the width, and the length of the gas-guiding flow channel 43 respectively are an axial dimension, a radial dimension, and a circumferential dimension of the gas-guiding flow channel 43.

As shown in FIG. 3, the gas-guiding flow channel 43 may be formed such that an axial height D1 of the gas-guiding flow channel 43 from the housing bottom surface 30*a* is larger than an axial gap D2 from the housing bottom surface 30*a* to the displacer upper surface 24*b* when the displacer 24 is positioned at the top dead center. The axial gap D2 corresponds to a minimum distance from the housing bottom surface 30*a* to the displacer upper surface 24*b* in the reciprocation of the displacer 24. In addition, the gas-guiding flow channel 43 may be formed such that the axial height D1 of the gas-guiding flow channel 43 from the housing bottom surface 30*a* is smaller than a radial width D3 of the gas-guiding flow channel 43. Even in this way, it is possible to prevent an excessive increase of the dead volume in the upper gas chamber 37 and it is possible to decrease a pressure drop in the upper gas chamber 37.

As shown in FIG. 2, the gas-guiding flow channel 43 extends around the central axis (for example, the displacer drive shaft 26) of the displacer 24. For example, the gas-guiding flow channel 43 is an annular groove which has the central axis of the displacer 24 as a center. In this way, it is possible to relatively easily process the gas-guiding flow channel 43.

As shown in the drawings, for example, a sectional shape of the gas-guiding flow channel 43 is rectangular. However, the present invention is not limited to this, and the gas-guiding flow channel 43 may have an arbitrary sectional shape.

The operation of the cryocooler 10 having the above-described configuration will be described. When the displacer 24 moves to the bottom dead center of the cylinder 28 or the position around the bottom dead center, the valve portion 34 is switched to connect the discharging port of the compressor 12 to the gas expansion chamber 40. Since the displacer 24 is positioned at the bottom dead center of the cylinder 28 or around the bottom dead center, the upper gas chamber 37 is wide. The high-pressure gas easily flows into the regenerator high-temperature portion 16*a* through the housing gas flow path 36, the gas-guiding flow channel 43, the upper gas chamber 37, and the displacer upper gas flow path 38 from the valve portion 34. The gas is cooled while passing through the regenerator 16 and enters the gas expansion chamber 40 through the displacer lower gas flow path 39 from the regenerator low-temperature portion 16*b*. While the gas flows into the gas expansion chamber 40, the displacer 24 moves toward the top dead center of the cylinder 28. Accordingly, the volume of the gas expansion chamber 40 increases. In this way, the gas expansion chamber 40 is filled with a high-pressure gas.

When the displacer 24 moves to the top dead center of the cylinder 28 or the position around the top dead center (refer to FIGS. 1 and 3), the valve portion 34 is switched so as to connect the suction port of the compressor 12 to the gas expansion chamber 40. The high-pressure gas is expanded and cooled in the gas expansion chamber 40. The expanded gas enters the regenerator 16 through the displacer lower gas flow path 39 from the gas expansion chamber 40. The gas is cooled while passing through the regenerator 16. The gas is returned from the regenerator 16 to the compressor 12 via the displacer upper gas flow path 38, the gas-guiding flow channel 43, the housing gas flow path 36, the valve portion 34, and the low-pressure gas chamber 42. While the gas flows out from the gas expansion chamber 40, the displacer 24 moves toward the bottom dead center of the cylinder 28. Accordingly, the volume of the gas expansion chamber 40 decreases and a low-pressure gas is discharged from the gas expansion chamber 40.

The above-described process is one-time cooling cycle in the cryocooler 10. The cryocooler 10 repeats the cooling cycle and cools the cooling stage 32 to a desired temperature. Accordingly, the cryocooler 10 can cool an object which is thermally connected to the cooling stage 32 to a cryogenic temperature.

When the displacer 24 is positioned at the top dead center, the axial gap between the housing bottom surface 30*a* and the displacer upper surface 24*b* is narrow, and for, example, is several millimeters (for example, approximately 1 to 3 mm). This is to decrease the dead volume. As described above, the gas-guiding flow channel 43 is formed on the housing bottom surface 30*a* and forms a portion of the upper gas chamber 37. The gas-guiding flow channel 43 causes the housing gas flow path 36 to communicate with the displacer upper gas flow path 38 when the displacer 24 is positioned at the top dead center in the axial reciprocation. Accordingly, even when the displacer 24 is positioned at the top dead center, the flow of the working gas between the housing gas flow path 36 and the displacer upper gas flow path 38 is secured. The gas can smoothly and uniformly flow in the regenerator 16. The pressure drop is decreased, and a decrease of the refrigeration capacity in the cryocooler 10 is prevented.

Figure 4:
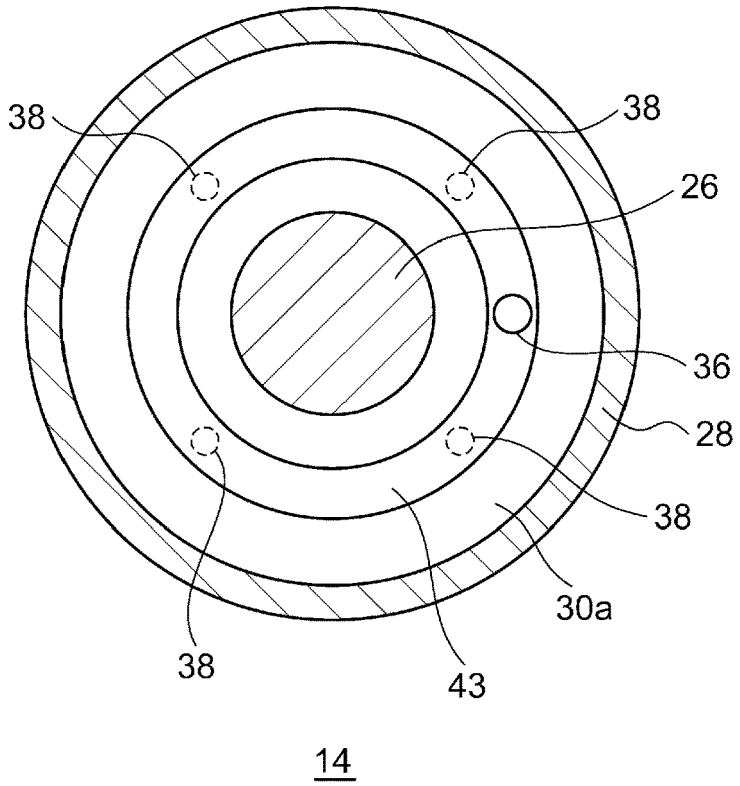
FIG. 4 shows a portion of the configuration of the working gas flow path of the expander according to an embodiment.

In an embodiment, as shown in FIG. 4, all of the plurality of holes of the displacer upper gas flow path 38 may be formed at positions different from the position of the housing gas flow path 36 in a cross section along the plane perpendicular to the axial direction (that is, in this case, the displacer upper gas flow path 38 does not exist immediately below the housing gas flow path 36). This configuration contributes to uniformity of the flow of the working gas.

Figure 5:
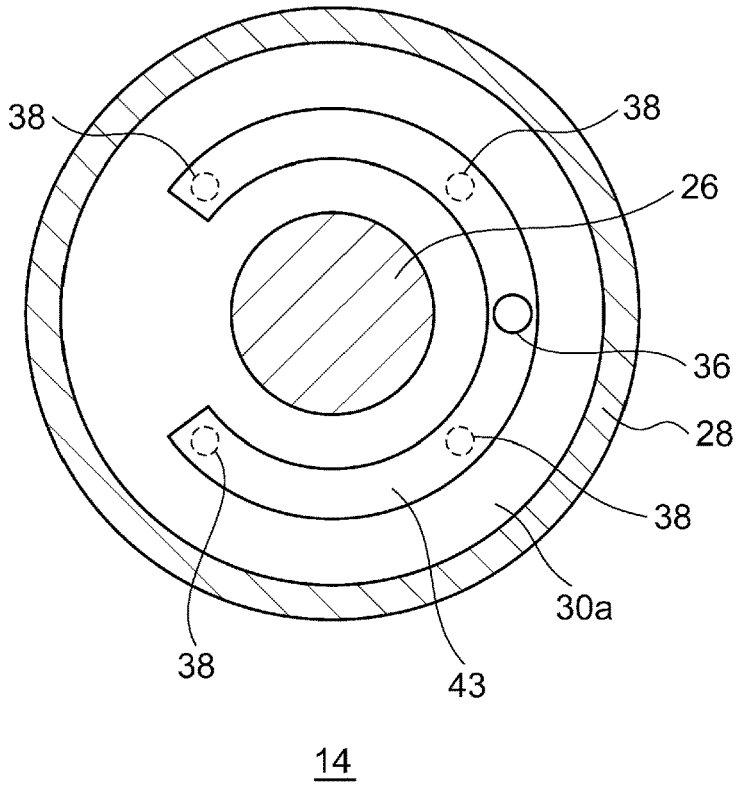
FIG. 5 shows a portion of the configuration of the working gas flow path of the expander according to an embodiment.

In an embodiment, the gas-guiding flow channel 43 may not extend over the entire circumference around the central axis of the displacer 24 as long as the gas-guiding flow channel 43 faces the plurality of holes. As shown in FIG. 5, for example, the gas-guiding flow channel 43 may be a C shaped groove. The C shaped gas-guiding flow channel 43 is open on a side opposite to the housing gas flowpath 36 and the hole serving as the displacer upper gas flow path 38 is disposed at each of two end portions of the gas-guiding flow channel 43. In this way, the length of the gas-guiding flow channel 43 decreases (compared to the case where the gas-guiding flow channel 43 is formed over the entire circumference), and it is possible to prevent an excessive increase of the dead volume due to the gas-guiding flow channel 43.

Figure 6:
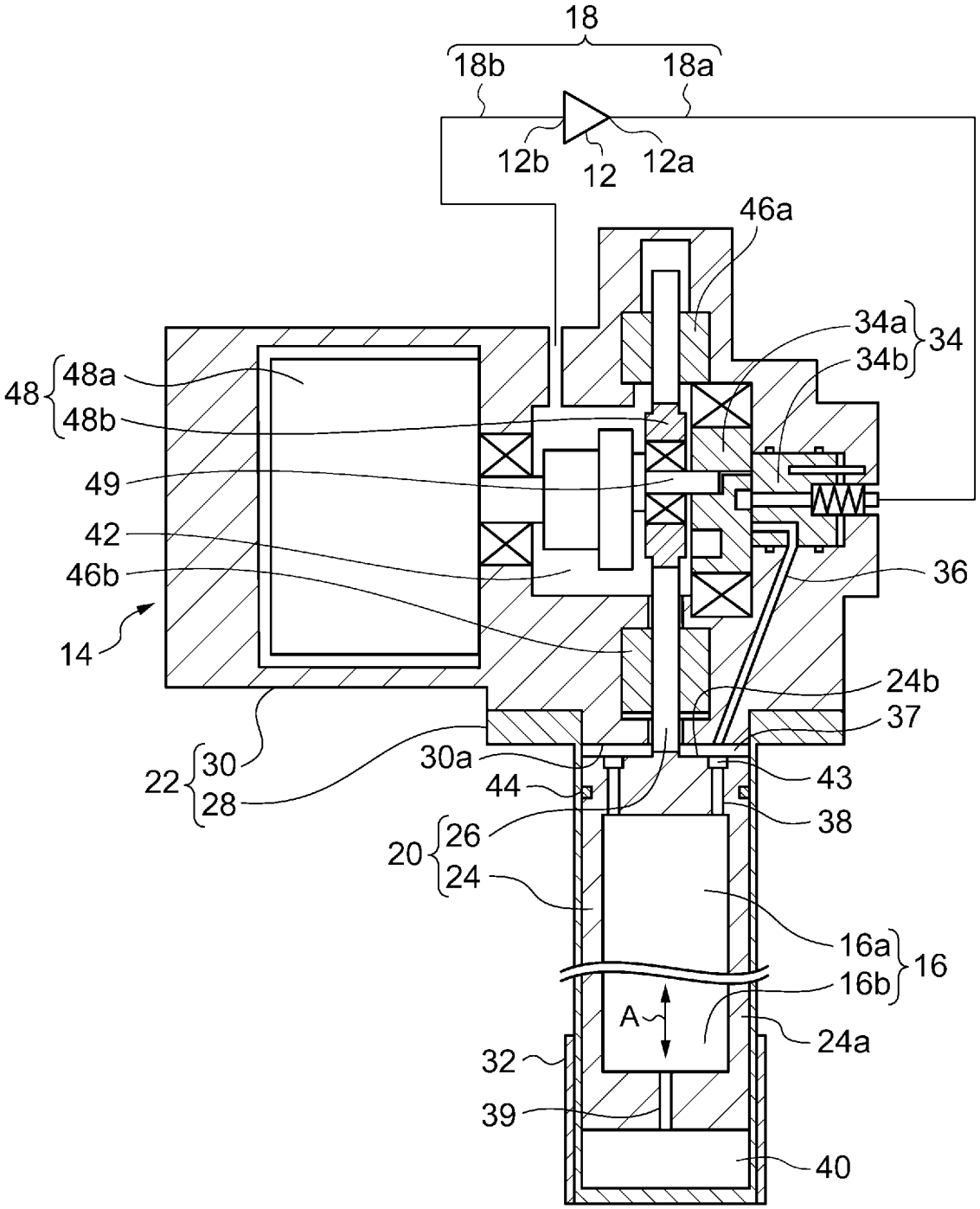
FIG. 6 is a view schematically showing an entire configuration of a cryocooler according to another embodiment.
Figure 7:
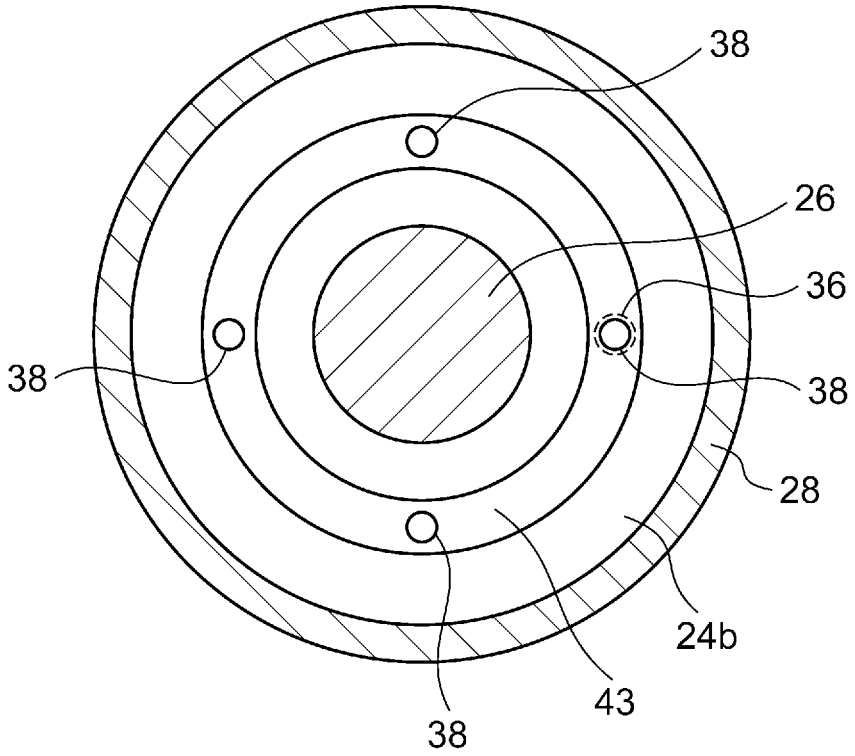
FIG. 7 shows a portion of a configuration of a working gas flow path of an expander according to another embodiment.

FIG. 6 is a view schematically showing an entire configuration of a cryocooler 10 according to another embodiment. FIG. 7 shows a portion of a configuration of a working gas flow path of an expander 14 according to another embodiment.

In the embodiment described with reference to FIGS. 1 to 3, the gas-guiding flow channel 43 is formed on the housing bottom surface 30*a*. However, the present invention is not limited to this. As shown in FIGS. 6 and 7, the gas-guiding flow channel 43 may be formed on the displacer upper surface 24*b*. The gas-guiding flow channel 43 is formed on the displacer upper surface 24*b* so as to face the housing gas flow path 36. The displacer upper gas flow path 38 includes a plurality of holes which are open to the gas-guiding flow channel 43. For understanding, the housing gas flow path 36 is shown by a dashed line in FIG. 7.

Even in this way, it is possible to prevent an excessive increase of the dead volume in the upper gas chamber 37 and it is possible to decrease the pressure drop in the upper gas chamber 37. In addition, it is possible to relatively easily process the gas-guiding flow channel 43, and manufacturability is improved.

Hereinbefore, the present invention is described based on the embodiments. The present invention is not limited to the embodiment, and a person skilled in the art understands that various design modifications can be applied, various modification examples can be applied, and the modification examples are also included in the scope of the present invention.

The gas-guiding flow channel 43 may be formed on both the housing bottom surface 30*a* and the displacer upper surface 24*b* forming a portion of the upper gas chamber 37. That is, a groove-shaped recess portion formed on the housing bottom surface 30*a* and a groove-shaped recess portion formed on the displacer upper surface 24*b* may be combined to form the gas-guiding flow channel 43.

As shown in the drawings, one housing gas flow path 36 is provided, and one outlet of the housing gas flow path 36 which is open to the upper gas chamber 37 is provided. However, in an embodiment, the housing gas flow path 36 may be divided in the housing 30 so as to have a plurality of outlets which are open to the upper gas chamber 37, or a plurality of housing gas flow paths 36 may be formed in the housing 30. A plurality of outlets of the housing gas flow path 36 which are open to the upper gas chamber 37 may be disposed on the housing bottom surface 30*a* (or the gas-guiding flow channel 43) so as to surround the displacer drive shaft 26.

In the above-described embodiments, the embodiments are described in which the cryocooler is a single-stage GM cryocooler. However, the present invention is not limited to this, and the configurations of the working gas flowpath according to the embodiments can be applied to a two-stage or a multiple-stage GM cryocooler, or can be applied to other cryocoolers such as a pulse tube cryocooler.

It should be understood that the invention is not limited to the above-described embodiment, but may be modified into various forms on the basis of the spirit of the invention. Additionally, the modifications are included in the scope of the invention.

What is claimed is:

1. A cryocooler, comprising:

a housing including a housing bottom surface;

a displacer including a displacer upper surface and being enabled to reciprocate axially with respect to the housing, an upper gas chamber is formed between the displacer upper surface and the housing bottom surface;

a housing gas flow path formed in the housing and opening into the upper gas chamber;

a displacer upper gas flow path formed in the displacer and opening onto the upper gas chamber; and a circumferentially continuous groove formed as a gas-guiding flow channel, the circumferentially continuous groove recessed on at least either the housing bottom surface or the displacer upper surface and extending circumferentially around the displacer's lengthwise center axis, the circumferentially continuous groove constituting a portion of the upper gas chamber and interconnecting the housing gas flow path and the displacer upper gas flow path when the displacer is positioned at top-dead center in its axial reciprocation, wherein gas can travel between the circumferentially continuous groove and the upper gas chamber.

2. The cryocooler according to claim 1, wherein:

the displacer upper gas flow path includes a plurality of holes formed in the displacer upper surface;

the gas-guiding flow channel is formed on the housing bottom surface, facing the plurality of holes; and the housing gas flow path opens on the gas-guiding flow channel.

3. The cryocooler according to claim 1, wherein:

the gas-guiding flow channel is formed on the displacer upper surface, facing the housing gas flow path; and the displacer upper gas flow path includes a plurality of holes opening onto the gas-guiding flow channel.

4. The cryocooler according to claim 1, wherein the gas-guiding flow channel is formed such that the gas-guiding flow channel's volume is not greater than half the upper gas chamber's volume when the displacer is positioned at top-dead center.

5. The cryocooler according to claim 1, wherein the circumferentially continuous groove is an annular or C-shaped groove extending around the displacer's lengthwise center axis.

* * * * *